US005518486A

United States Patent [19]

Sheeler

[11] Patent Number: 5,518,486

[45] Date of Patent: May 21, 1996

[54] EXERCISE STRAP DEVICE

[76] Inventor: Judith M. Sheeler, 17732 Alexander Rd., Walton Hills, Ohio 44146

[21] Appl. No.: 387,124

[22] Filed: Feb. 13, 1995

[51] Int. Cl.[6] ..... A63B 21/002

[52] U.S. Cl. ..... 482/131; 482/907; 482/139

[58] Field of Search ..... 482/907, 91, 131, 482/139, 110, 126, 124, 125; 602/4

[56] References Cited

U.S. PATENT DOCUMENTS

| | | | |
|---|---|---|---|
| 1,012,802 | 12/1911 | Brogan . | |
| 1,304,153 | 5/1919 | Bugge | 602/4 |
| 1,605,792 | 11/1926 | Simmons . | |
| 1,706,654 | 3/1929 | Christesen . | |
| 2,160,722 | 5/1939 | Cunningham . | |
| 2,543,847 | 3/1951 | Hallstedt | 602/4 |
| 2,616,419 | 11/1952 | Karfiol | 602/4 |
| 3,062,543 | 11/1962 | Shaboo et al. . | |
| 3,068,002 | 12/1962 | Balne . | |
| 3,068,003 | 12/1962 | Portman et al. . | |
| 3,554,194 | 1/1971 | Johnson | 602/4 |
| 3,739,772 | 6/1973 | Ennis | 602/4 |
| 4,245,840 | 1/1981 | Van Housen | 482/124 |
| 4,251,070 | 2/1981 | Leseberg . | |
| 4,456,249 | 6/1984 | Calabrese | 482/131 |
| 4,552,356 | 11/1985 | Brousseau . | |
| 4,751,923 | 6/1988 | Marino | 602/4 |
| 4,756,527 | 7/1988 | Ledbetter | 482/139 |
| 5,069,449 | 12/1991 | Wardwell . | |
| 5,372,566 | 12/1994 | Olschansky et al. | 482/91 |

*Primary Examiner*—Lynne A. Reichard

[57] ABSTRACT

An inexpensive, light-weight, easy to use exercise device which is comprised of a harness having an adjustable flexible, inelastic strap with and adjustable foot loop at one end and a hand grip at the other end. Most exercises are performed using two exercise harnesses. While holding the hand grips and having placed the feet in the foot loops, the user exerts opposing forces between the arms and legs in a variety of exercises while lying down, standing, or sitting. By varying the strength of the forces exerted and the speed of the motion, the user can do isometric, isotonic, stretching, or aerobic exercises.

16 Claims, 2 Drawing Sheets

EXERCISE STRAP DEVICE

BACKGROUND-FIELD OF INVENTION

This invention relates to personal exercise devices, and more particularly to a light-weight, easy to use aid for stretching, toning, and aerobic exercising.

BACKGROUND-DISCUSSION OF PRIOR ART

There are many exercise devices available. While all have some distinct benefits, most also have certain disadvantages. Some are excellent, but are heavy and bulky, and may even need a special room. Others utilize elastic bands which may snap and cause injury. Also, the elastic material may not be the optimal strength, and may be either too weak or too strong. Many fine exercise devices are limited to exercising only certain parts of the body. More than one exercise device may be necessary to obtain a more thorough work-out. Some exercise devices offer a variety of exercising options, but they are time consuming or difficult to adjust to these various forms of exercising. Often exercise devices are very costly.

Other inventors have addressed some of these disadvantages. U.S. Pat. No. 4,251,070 to Leseberg (1981) shows a supine exercise device. It has a hand grip bar which has a pull cord attached. The pull cord extends from either side of the hand grip bar and both ends attach at the user's foot to a moccasin-like foot cradling assembly. This exercise harness can be used for many supine exercises but it has distinct disadvantages because the leg of the user must pass between the pull cords. This can lead to some skin irritation if the pull cords rub on the user's legs. Also the pull cords emanate from either side of the hand grips. They create a projection that rubs against the legs and body unless the hands are positioned in such a way as to avoid this. Thus the positions of the hands and arms are restricted and the user may not be able to exercise some muscle groups sufficiently. It also appears that it would be somewhat difficult to adjust the length of the pull cords. The moccasin-like device seems somewhat complicated and might be uncomfortable if one desired to pull strongly on the feet.

U.S. Pat. No. 4,552,356 to Brousseau (1985) also discloses a simple exercise harness. It is comprised of a set of hand grip tubes each having an inelastic strap similar to seat belt material looped through them. The grips are connected with an elastic cord. The user can lie down and perform a bicycling-type motion with his feet in the loops of strap and his hands pulling on the hand grips. The elastic cord is designed to provide some resistance and coordination of movement. A major disadvantage of this device is the lack of a means for keeping the strap loops on the user's feet. Unless tension is maintained, they will fall off. Also, the user's legs must pass between the loops of strap material, which could cause chafing. In addition, the user can only perform a limited number of exercises with this device.

U.S. Pat. No. 1,605,792 to Simmons (1926) also shows a supine exercise device. It is comprised of a foot holding device for both feet and a set of straps with hand grips extending from either side of the foot holder. The major disadvantage is that the feet are held together and cannot be moved separately. Also it has a somewhat complicated construction.

There are also many exercise devices that utilize elastic bands or straps to pull against, such as in U.S. Pat. No. 1,706,654 to Christesen (1929). Any device that utilizes elastic material generally cannot maximize or precisely control the force that is applied by the arms and legs in opposition to each other. They also have the distinct disadvantage that the elastic material might break and snap back upon the user causing injury.

OBJECTS AND ADVANTAGE

Accordingly, in view of the above disadvantages, several of the objects and advantages of this invention are:

(a) to provide a simple exercise device which is an exercise harness comprised of a flexible, inelastic strap with a foot loop at one end and a hand grip at the other end. This harness is easily adjustable to different lengths and has an adjustable foot loop;

(b) to provide an exercise device which is light-weight, durable, and inexpensive;

(c) to provide an exercise device which can be used to perform a variety of isometric, isotonic, stretching, and aerobic exercises;

(d) to provide an exercise device that is easy to adjust for a variety of exercises. One can quickly change forms of exercise so as not to become bored or incur muscle spasm form performing one type of exercise too long;

(e) to provide an exercise device that may be used lying down while utilizing opposing forces between arms and legs to stimulate muscle development;

(f) to provide and exercise device that can be used sitting or standing;

(g) to provide an exercise device with which a person can control the strength of forces applied to various muscle groups so as to maximize desired beneficial effects; and (h) to provide an exercise harness with a single strap between the foot loop and the hand grip. Having a single strap instead of a loop of material from hand to foot, makes the harness more versatile since the knee and leg do not have to pass between a loop of material while exercising.

Still further objects and advantages will become apparent from a consideration of the ensuing description and drawings.

DRAWING FIGURES

Figure 3A:
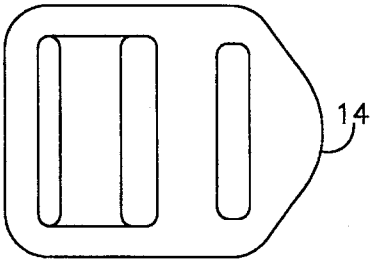
FIG. 3A shows a top view of a buckle 14.
Figure 3B:
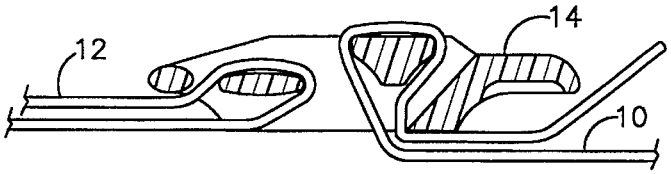

FIG. 3B shows a cut-away view of buckle 14 with straps 10 and 12 inserted in it.

Figure 4A:
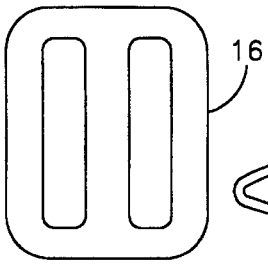

FIG. 4A shows a top view of a buckle 16.

Figure 4B:
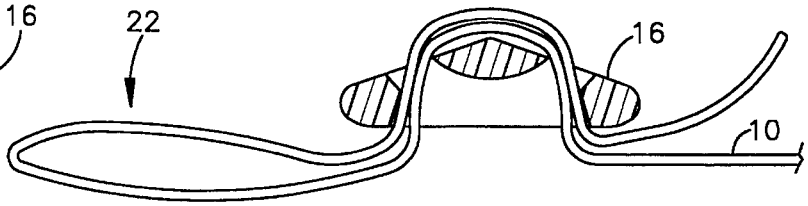

FIG. 4B shows a cut-away view of buckle 16 with strap 10 inserted in it.

FIGS. 5A to 5E show views of a person using the exercise harnesses.

LIST OF REFERENCE NUMBERS IN DRAWINGS

10 strap with loop for foot
12 strap for hand grip
14 buckle for hand grip
16 buckle for loop for foot
18 hand support
20 sewn area of strap 12
21 hand grip assembly
22 foot loop formed from strap 10
24 buckle to secure extra length of strap 10

26 foam padding part of hand grip
28 non-bending, hollow cylinder part of hand grip
30 end of strap 10 coming from hand grip

DESCRIPTION—FIGS. 1 to 5E

Figure 1:
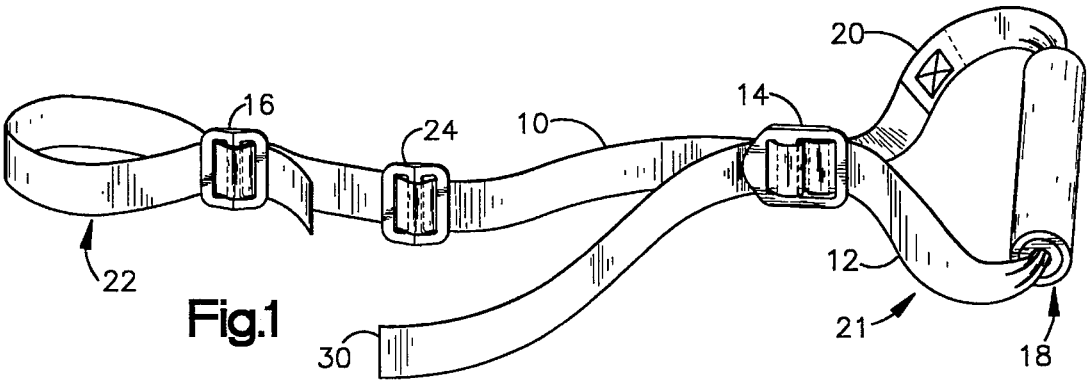
FIG. 1 shows a perspective view of the exercise harness.
Figure 2:
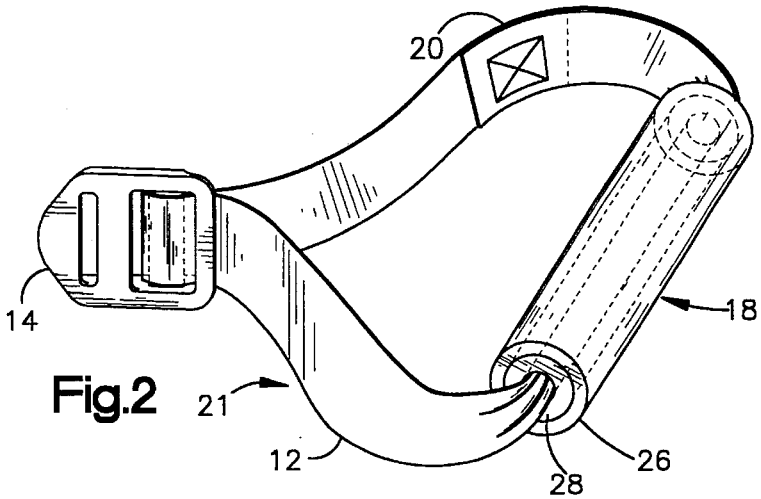
FIG. 2 shows a perspective view of the hand grip assembly 21 separated from the harness.

FIG. 1 shows a perspective view of the exercise device. It shows an exercise harness comprised of a strap 10 with a foot loop 22 at one end and a hand grip assembly 21 at the other end. Typically, strap 10 may be 5—6 feet long, although it may be shorter or longer as deemed suitable. The foot loop 22 is easily adjustable using a buckle 16. The other end of strap 10 passes through a buckle 14 which is attached to a strap 12. The length of strap 10 between the foot loop 22 and the hand grip assembly 21 is easily adjusted using buckle 14. Strap 12 is looped through buckle 14 and through a hand support 18, and the ends of strap 12 are sewn together in an area 20 to complete this hand grip assembly. Buckle 24 is identical to buckle 16 and is optional. It is used to hold the loose end 30 of strap 10. Hand grip assembly 21 can be easily removed from strap 10. Strap 12 moves easily through buckle 14. This movement is helpful in maintaining a directional pull while exercising FIG. 2 shows the hand grip assembly 21 disconnected from strap 10. It shows the hand support 18 comprised of a piece of strong plastic tubing 28 which is approximately 5 inches long. A piece of cylindrically shaped foam 26 covers tube 28 to provide cushioning for a hand. Hand support 18 can be constructed of any material which does not bend and is comfortable to grip. A bendable hand support is not desirable because the fingers are pinched together when strong force is applied to strap 10. However, if one performs exercises without applying strong forces, such as in an aerobic manner, a simple cushioning device such as a foam bicycle grip may be suitable for use on the hand grip assembly.

Strap 10 can be composed of any flexible, strong, inelastic strap material such as polypropylene, nylon, or other natural or manmade material. A preferred embodiment is 1 inch wide polypropylene, web-type strap that is approximately 1/16 inch thick. The 1 inch wide strap material is wide enough to distribute strong force comfortably on a foot in a shoe. A wider strap may be used, but may be less comfortable and not as versatile with a wide variety of exercises. However, a wider or stronger strap may be desirable if extreme force will be used during exercise. Rope may be used, but it is not as comfortable on the foot. The flat strap is comfortable to stand on when doing stretching and isometric exercises. The foot loop may also be sewn into the strap 10, but it is deemed more desirable to be able to adjust the foot loop with buckle 16. Cushioning may be added to the foot loop if desired.

FIG. 3A shows a 1 inch LADDERLOC TM buckle, manufactured by ITW Nexus. This buckle is a preferred embodiment of buckle 14, but any other similar buckle or fastener made of plastic, metal or other strong material could be used. FIG. 3B shows how strap 10 and strap 12 are looped through buckle 14.

FIG. 4A shows a TRI-GLIDE TM buckle manufactured by ITW Nexus. This buckle is a preferred embodiment of buckle 16, but any suitable buckle or fastener made of various strong materials could be used. FIG. 4B shows how strap 10 is inserted in buckle 16.

FIGS. 5A to 5E show various exercises that can be performed using the exercise harness shown in FIG. 1. For many exercise routines, two exercise harnesses are used.

OPERATION OF THE INVENTION

Figure 5A:
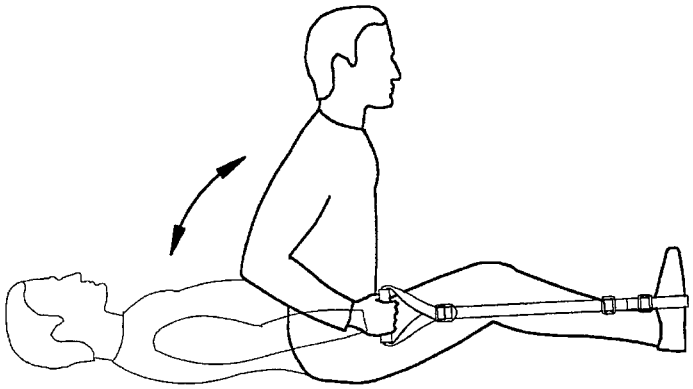

The exercise harness shown in FIG. 1 is easy to use and adjust. Typically, a person would lie on the floor and hold two harnesses as shown in FIG. 5A. The length would be adjusted so that, in the prone position, the harnesses are taut between the hands and feet, while the arms and legs are straight and the arms are alongside the body. This length is a good one for a wide variety of exercises. Length adjustments can be made by holding buckle 14 and pulling strap 10 through it. The foot loop size can be adjusted by moving strap 10 through buckle 16. The foot loop can be made small enough so it won't fall off the foot.

Once the harnesses are adjusted, one can perform the exercise shown in FIG. 5A. While lying on the floor, pull on the hand grips to raise the upper body to a sit-up position. Next, lower the upper body to the floor while using the arms and harnesses for support. Some people may need to place their feet under a heavy chair or similar object. By repeating this pattern, one exercises the muscles of the arms, shoulders, stomach, and back. If performed quickly, it is similar to a rowing machine exercise, and is an aerobic exercise. The legs may also be exercised by bending and straightening them while doing this rowing motion. One can also choose which muscles groups will exert the most force, by choosing to use more or less support from the arm muscles or the stomach muscles. By using the arms to pull upright, the user will not strain the back muscles.

Figure 5B:
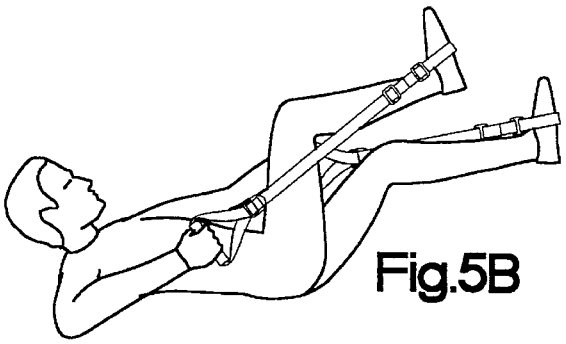

A second exercise is shown in FIG. 5B. This is essentially a bicycling-type motion performed while lying on one's back. The arms and legs can exert strong force in opposition to each other which will lead to development of greater muscle strength. If one performs the exercise slowly, while concentrating on pulling strongly with the hands and pushing strongly with the feet, a very satisfying amount of exertion is felt. One can also do this exercise quickly with less force and achieve an aerobic effect.

A satisfying routine can be performed by switching periodically between the sit-up exercise and the bicycling exercise and varying the speed and force of each exercise. One can also perform a wide variety of swimming, stretching, and scissor-like motions while lying on one's back. Strap 10 should be adjusted as desired. It is advantageous to be able to switch between exercises easily and quickly. This helps avoid boredom and helps prevent muscle spasms from doing one form of exercise too long. Using the exercise harness for a short time, even 10 minutes several times a week, will be enough to build muscle strength if one uses it forcefully.

Figure 5C:
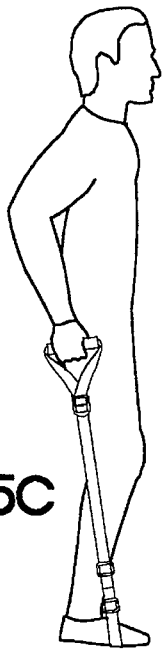
Figure 5D:
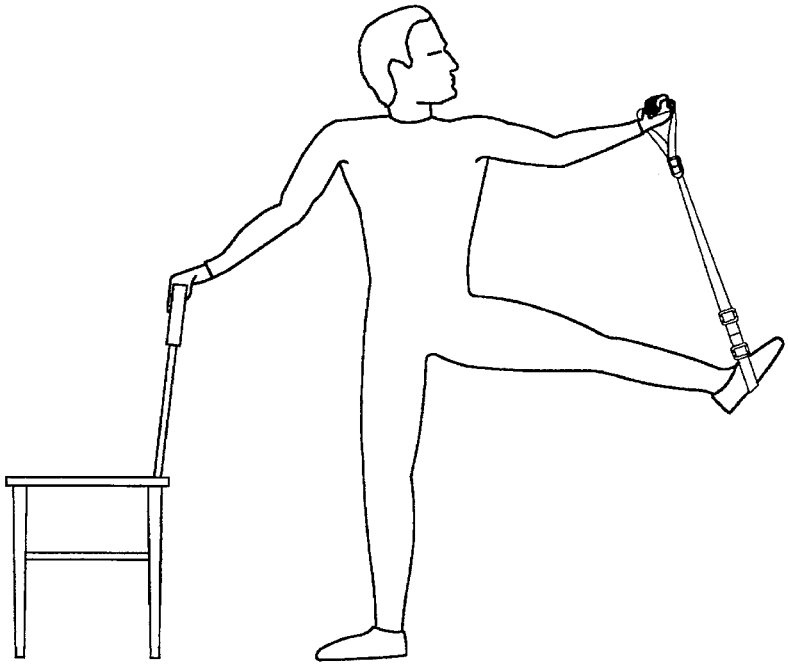
Figure 5E:
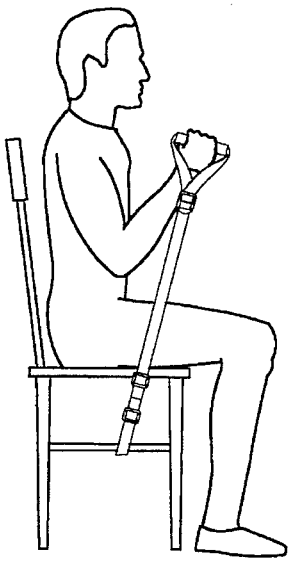

Another exercise is shown in FIG. 5C. One stands on the foot loops and pulls up on the hand grips while flexing the knees. This exercise is useful in simulating the leg action used in skiing and is helpful in developing the leg muscles. Arms and legs are flexed in opposition to one another in a kind of bobbing up and down motion. The length of the strap 10 should be adjusted to achieve the desired result.

One can also stand by a chair as shown in FIG. 5 D and do a variety of stretching exercises, by lifting one's leg to a desired height by pulling on the hand grip. One can also attach the foot loops to chair rungs as shown in FIG. 5E. By adjusting the length of strap 10, one can do a variety of isometric arm exercises while sitting, by pushing or pulling against the hand grip with strap 10 connected to the chair rung. One can also sit on a sofa or easy chair and use the harness in a bicycling or isometric exercise while watching television.

Two hand grip assemblies 21 can be connected together on one strap 10 after removing buckle 16. In this form, the harness can be used for isometric arm exercises by applying opposing forces with the arms while gripping the hand grips.

These exercises are only some examples of the wide variety of exercises that can be performed with this exercise device. It is inexpensive, light-weight, easy to use, and can provide an easy or forceful exercise routine as desired by the user. It is especially well-suited to be used while traveling.

SUMMARY, RAMIFICATIONS, AND SCOPE

Accordingly, the above description and drawings show an exercise harness comprised of a single, strong, flexible, inelastic, elongated member which has a hand grip at one end and a foot holder at the other end. The flexible, inelastic member is usually comprised of a single strap which is easily adjustable in length. This allows the harness to be extremely versatile and to be used in a wide variety of exercise routines. For example, it has distinct advantages over those exercise devices which have loops of material through which the leg must pass while exercising. In particular, the hands and arms are not as constrained to certain positions, as they are with the exercise device having leg loops. Also the single strap can be held away from the legs so as not to chafe the legs as may happen while using leg loops.

A preferred embodiment is a harness that has an adjustable foot loop at one end made from a loop of the strap material of the elongated member. One advantage is that the loop may be made just large enough for a foot in a shoe so that the loop will not fall off easily. A flat strap is also comfortable to stand on. The foot loop may also be opened and attached to other objects, such as a chair rung, in order to do isometric exercise. Furthermore, other advantages of this invention are:

(a) it is light-weight, durable, and inexpensive;

(b) it allows the user to apply opposing force between the arms and the legs in a wide variety of exercise thereby providing the ability to actually strengthen many muscle groups including those in the stomach, back, shoulders, arms and legs;

(c) it can be used lying down, sitting, or standing;

(d) it allows the user to apply resistance for muscle building and movement for flexibility at the same time;

(e) it allows the user to build muscle strength with a relatively short exercise period, such as 10 minutes several times a week;

(f) it has removable handles which can be connected together on one strap for use as an isometric arm exerciser;

(g) it allows the user to control the force and the speed of the exercises;

(h) it allows the user to vary the types of exercise quickly;

(i) it provides the ability to do an aerobic sit-up exercise that can strengthen the stomach and back, while increasing flexibility without injury by using the arms and harness for support while doing the sit-ups; and (j) it is extremely versatile and allows the user to do isometric, isotonic, stretching, and aerobic exercises.

While the above description contains many specifics, these should not be construed as limitations on the scope of the invention, but rather as preferred embodiments thereof. Many variations are possible, some of which are mentioned in the above description. For example, the strap may be made of a variety of strong, flexible, inelastic materials of various colors. The straps 10 and 12 could be replaced by some other flexible, inelastic means. The plastic buckles 14 and 16 could be made of any suitable strong material. Some other adjustable fastener means could by used. The hand grip could certainly be made in other shapes and sizes which provide a firm, comfortable grip. The exercise strap 10 can vary in length as desired. Other variations are possible.

Thus the scope of the claim should be determined by the appended claims and their legal equivalents, rather than by the examples given.

I claim:

1. An exercise device comprising:

(a) an inelastic, flexible strap having a first end and a second end;

(b) a first buckle slideably positioned on said strap near said first end of said strap and a second buckle slideably positioned on said strap near said second end of said strap;

(c) a portion of said strap adjacent said first end of said strap threaded through said first buckle forming a loop, said loop having an adjustable diameter so as to releasably secure a foot of a user inserted into said loop;

(d) a hand grip assembly including:

i) an endless strip of inelastic, flexible material;

ii) a hollow cylinder slideably overlying a portion of said endless strip of material, the hollow cylinder adapted to by gripped by a hand of a user;

iii) said endless strip of material threaded through said second buckle; and (e) a portion of said strap adjacent said second end of said strap threaded through said second buckle to secure said hand grip assembly to said strap, said second buckle being slideable along said strap to change a length of said strap between said loop and said hand grip assembly.

2. An exercise device as in claim 1 wherein said second buckle is slideable along said endless strip.

3. An exercise device as in claim 2 wherein said hand grip assembly is removable from said strap.

4. An exercise device comprising:

(a) an inelastic, flexible strap having a first end and a second end;

(b) a loop fastened to said first end of said strap adapted to receive a foot of a user;

(c) a hand grip assembly comprising:

i) an endless strip of inelastic, flexible material;

ii) a hand supporting means positioned on a portion of said endless strip of material;

iii) a first buckle through which said endless strip of material is threaded; and (d) a portion of said strap adjacent said second end of said strap threaded through said first buckle to secure said hand grip assembly to said strap, said first buckle being slideable along said strap to change a length of said strap between said loop and said hand grip assembly, and whereby said hand grip assembly can be positioned at any place on said strap between said loop and said second end of said strap.

5. An exercise device as in claim 4 wherein said loop is formed by fastening said first end of said strap to a portion of said strap spaced from said first end by means of a second buckle whereby said loop is adjustable in size.

6. An exercise device as in claim 5 wherein said hand supporting means is a hollow cylinder adapted to be gripped by the user.

7. An exercise device as in claim 6 wherein said hollow cylinder is slideably positioned overlying said endless strip.

8. An exercise device as in claim 7, wherein said first buckle through which said endless strip is threaded is slideably positioned on said endless strip.

9. An exercise device as in claim 8, wherein said hand grip assembly is removable from said strap.

10. An exercise device comprising:

(a) a flexible, inelastic strap with a first end and a second end;

(b) a loop fastened to the first end of said strap;

(c) an endless strip of flexible, inelastic material threaded through a first buckle; and (d) a portion of said strap adjacent to said second end of said strap threaded through said first buckle to secure said first buckle to said strap, said first buckle being slideable on said strap to change a length of said strap between said loop and said endless strip, and whereby said endless strip and said first buckle can be positioned at any place on said strap between said loop and said second end of said strap.

11. An exercise device as in claim 10 wherein said loop is formed by said first end of said strap being fastened to a portion of said strap spaced from said first end by a second buckle whereby the size of said loop is adjustable.

12. An exercise device as in claim 11 wherein a hand supporting means is attached to said endless strip.

13. An exercise device as in claim 12 wherein said hand supporting means is a rigid, hollow cylinder positioned overlying said endless strip.

14. An exercise device as in claim 11 wherein a cushioning means is attached to said endless strip.

15. An exercise device as in claim 13 wherein said first buckle attached to said endless strip is slideably attached to said endless strip.

16. An exercise device as in claim 15 wherein said first buckle attached to said endless strip is removable from said strap.

* * * * *